US005556732A

United States Patent [19]

Chow

[11] Patent Number: 5,556,732

[45] Date of Patent: Sep. 17, 1996

[54] PROCESSES FOR PREPARING TONERS WITH SELECTABLE GLOSS

[75] Inventor: Che C. Chow, Penfield, N.Y.

[73] Assignee: Xerox Corporation, Stamford, Conn.

[21] Appl. No.: 453,177

[22] Filed: May 30, 1995

[51] Int. Cl.[6] ..... G03G 9/087

[52] U.S. Cl. ..... 430/137; 430/109; 430/904; 525/444

[58] Field of Search ..... 430/137, 109; 525/444

[56] References Cited

U.S. PATENT DOCUMENTS

| | | | |
|---|---|---|---|
| 4,863,824 | 9/1989 | Uchida et al. | 430/109 |
| 4,894,308 | 1/1990 | Mahabadi et al. | 430/137 |
| 5,227,460 | 7/1993 | Mahabadi et al. | 430/109 |
| 5,234,787 | 8/1993 | Morimoto et al. | 430/109 |
| 5,234,788 | 8/1993 | Morimoto et al. | 430/109 |
| 5,312,704 | 5/1994 | Fuller et al. | 430/109 |
| 5,376,494 | 12/1994 | Mahabadi et al. | 430/137 |
| 5,395,723 | 3/1995 | Mahabadi et al. | 430/109 |
| 5,401,602 | 3/1995 | Mahabadi et al. | 430/137 |
| 5,407,772 | 4/1995 | Bayley et al. | 430/137 |
| 5,480,756 | 1/1996 | Mahabadi et al. | 430/109 |

*Primary Examiner*—Christopher D. Rodee
*Attorney, Agent, or Firm*—John L. Haack

[57] ABSTRACT

A process for preparing low fix temperature toner resin mixture comprising melt blending a resin mixture comprised of a first polyester resin with a low gloss value, and a second polyester resin with a high gloss value, to form a toner resin mixture having an intermediate gloss value.

26 Claims, 3 Drawing Sheets

PROCESSES FOR PREPARING TONERS WITH SELECTABLE GLOSS

CROSS REFERENCE TO APPLICATIONS AND ISSUED PATENTS

Attention is directed to commonly owned and assigned applications: U.S. Ser. No. 08/131,250, filed Oct. 4, 1993, now U.S. Pat No. 5,393,630 entitled "Melting Mixing Processes"; and U.S. Ser. No. 08/393,606 filed Feb. 23, 1995, now U.S. Pat. No. 5,536,613 entitled "Processes for Preparing Toner"; and U.S. Ser. No. 08/164,853 filed Dec. 10, 1993 (now abandoned) and continuation in part applications U.S. Ser. No. 08/314,759, now U.S. Pat. No. 5,531,813 and Ser. No. 08/315,006, now U.S. Pat. No. 5,512,409 filed Sep. 29, 1994, entitled "Fusing System With Monoamino Functional Silicone Release Agent," and "Fusing Method and System with Hydrofluoroelastomers Fuser Member For Use With Amino Functional Silicone Oils", respectively.

Attention is directed to commonly owned and assigned U.S. Pat. No. 5,227,460, filed Dec. 30, 1991, entitled "Cross-Linked Toner Resins"; U.S. Pat. No. 5,312,704, issued May 17, 1994, entitled "Monomodal, Monodisperse Toner Compositions and Imaging Processes Thereof"; U.S. Pat. No. 5,376,494, filed Dec. 30, 1991, entitled "Reactive Melt Mixing Process for Preparing Cross-Linked Toner Resin"; U.S. Pat. No. 5,401,602, filed Mar. 23, 1993, entitled "Reactive Melt Mixing Process For Preparing Cross-Linked Toner Resin"; U.S. Pat. No. 5,352,556, filed Mar. 23, 1993, entitled "Cross-linked Toner Resins Formed by Reactive Melt Mixing"; U.S. Pat. No. 5,407,772, filed Nov. 30, 1993, entitled "Unsaturated Polyesters"; U.S. Pat. No. 4,894,308 to Mahabadi et al.; and U.S. Pat. No. 4,973,439 to Chang et al., discloses extrusion processes for preparing electrophotographic toner compositions in which pigment and charge control additive were dispersed into the binder resin in the extruder.

The disclosures of the above mentioned patents and copending applications are incorporated herein by reference in their entirety.

BACKGROUND OF THE INVENTION

The present invention is generally directed to processes for the preparation of toner resins and toners. More specifically, the present invention relates to melt mixing processes, batch or continuous, but preferably continuous processes such as, for example, non-reactive extrusion for preparing toner resin blends containing, in embodiments, mixtures of two partially crosslinked resin, and in other embodiments, mixtures of a partially crosslinked resin and an uncrosslinked resin, wherein the resulting toners have optimized gloss properties, broad fusing latitudes, and extended fuser roll life.

Toner utilized in development in the electrographic process is generally prepared by mixing and dispersing a colorant and a charge enhancing additive into a thermoplastic binder resin, followed by micropulverization. As the thermoplastic binder resin, numerous polymers are known, including polystyrenes, styrene-acrylic resins, styrene-methacrylic resins, polyesters, epoxy resins, acrylics, urethanes and copolymers thereof. As the colorant, carbon black, magnetite and various colored pigments may be selected, and as the charge enhancing additive, alkyl pyridinium halides, distearyl dimethyl ammonium methyl sulfate, metallic alkyl salicylates, and the like are known.

To fix the toner to a support medium, such as a sheet of paper or a transparency, hot roll fixing is commonly used. In this method, the support medium carrying a toner image is transported between a heated fuser roll and a pressure roll, with the image face contacting the fuser roll or belt. Upon contact with the heated fuser roll or belt, the toner melts and adheres to the support medium, forming a fixed image. Such a fixing system is very advantageous in heat transfer efficiency and is especially suited for high speed electrophotographic processes.

Fixing performance of the toner can be characterized as a function of temperature. The lowest temperature at which the toner adheres to the support medium is called the Cold Offset Temperature (COT), and the maximum temperature at which the toner does not adhere to the fuser roll is called the Hot Offset Temperature (HOT). When the fuser temperature exceeds HOT, some of the molten toner adheres to the fuser roll during fixing and is transferred to subsequent substrates containing developed images, resulting for example in blurred or extraneous images. This undesirable phenomenon is called offsetting. Between the COT and HOT of the toner, is the Minimum Fix Temperature (MFT) which is the minimum temperature at which acceptable adhesion of the toner to the support medium occurs, as determined by, for example, a creasing test. The difference between MFT and HOT is called the Fusing Latitude, and the temperature range therebetween is referred to the fusing range.

The hot roll or belt fixing system and a number of toners used therein, however, exhibit several problems. First, the binder resins in the toners can require a relatively high temperature in order to be affixed to the support medium. This may result in high power consumption. Low vinyl type binder resins such as styrene-acrylic resins may have an additional problem known as vinyl offset. Vinyl offset occurs when a sheet of paper or transparency with a fixed toner image comes in contact for a period of time with, for example, a polyvinyl chloride (PVC) surface containing a plasticizer used in making the vinyl material flexible such as, for example, in vinyl notebook binder covers, and the fixed image adheres to the PVC surface. Another problem, particularly for highlight and process color applications is the inability to readily form images which have variable or operator selectable gloss properties, for example, images having colored regions with high gloss levels and black regions, for example text regions, with low or intermediate gloss levels.

In the aforementioned copending U.S. Ser. No. 08/393,606 is disclosed a process for the preparation of pigmented toner compositions comprising: forming at a first temperature, a first melt mixture comprised of a partially crosslinked thermoplastic resin, pigment, optionally a wax, and optional additives, wherein the partially crosslinked thermoplastic resin is comprised of a mixture of crosslinked resin macrogel particles, crosslinked resin microgel particles, and uncrosslinked resin; and melt mixing at a second temperature, the first melt mixture to form a second mixture, wherein the macrogel particles are partially converted into microgel particles, and wherein the second temperature is less than or equal to the first temperature.

In the aforementioned commonly assigned U.S. Pat. No. 5,312,704, are disclosed imaging processes and toner compositions comprised of pigment particles, and a resin, for example, anionically polymerized styrene-butadiene, comprised of a monomodal polymer resin or monomodal polymer resin blends, and wherein the monomodal resin or resin blends possess a narrow polydispersity. Also disclosed are toner compositions comprised of monomodal toner resins with low, high, or intermediate gloss properties. The high weight average molecular weight monomodal resins generally have low gloss properties, the low weight average molecular weight monomodal resins generally have high gloss properties, and the intermediate weight average molecular weight monomodal resins or blends of low and high weight average molecular weight monomodal resins generally possess gloss properties intermediate between the aforesaid high and low gloss properties.

In order to prepare lower fix temperature resins for toner, the molecular weight of the resin may be lowered. Low molecular weight and amorphous polyester resins and epoxy resins have been used to prepare low temperature fixing toners. For example, attempts to produce toners utilizing polyester resins as binder are disclosed in U.S. Pat. No. 3,590,000 to Palermiti et al. and U.S. Pat. No. 3,681,106 to Burns et al. The minimum fixing temperature of polyester binder resins can be rendered lower than that of other materials, such as styrene-acrylic resins. However, this may lead to a lowering of the hot offset temperature and, as a result, decreased offset resistance. In addition, the glass transition temperature of the resin may be decreased, which may cause the undesirable phenomenon of blocking of the toner during storage.

To prevent fuser roll or belt offsetting and to increase fusing latitude of toners, modification of the binder resin structure by conventional polymerization processes, for example, by branching, cross-linking, and the like, has been attempted. For example, in U.S. Pat. No. 3,681,106 to Burns et al., a process is disclosed whereby a polyester resin was improved with respect to offset resistance by non-linearly modifying the polymer backbone by mixing a trivalent or more polyol or polyacid with the monomer to generate branching during polycondensation. However, an increase in degree of branching may result in an elevation of the minimum fix temperature. Thus, any initial advantage of low temperature fix may be diminished.

Another method of improving offset resistance is by cross-linking during polymerization. In U.S. Pat. No. 3,941,898 to Sadamatsu et al., for example, a cross-linked vinyl type polymer prepared using conventional cross-linking was used as the binder resin. Similar disclosures for vinyl type resins are presented in U.S. Pat. No. Re. 31,072 (a reissue of U.S. Pat. No. 3,938,992) to Jadwin et al., U.S. Pat. No. 4,556,624 to Gruber et al., U.S. Pat. No. 4,604,338 to Gruber et al., and U.S. Pat. No. 4,824,750 to Mahalek et al. Also, disclosures have been made of cross-linked polyester binder resins using conventional polycondensation processes for improving offset resistance, such as for example in U.S. Pat. No. 3,681,106 to Burns et al.

While significant improvements can be obtained in offset resistance and entanglement resistance, a major drawback may ensue with these kinds of cross-linked resins prepared by conventional polymerization, including solution, bulk, suspension and emulsion polymerizations and polycondensation processes. In all of these processes, monomer and cross-linking agent are added to the reactor at the same time. The cross-linking reaction is not very fast and chains can grow in more than two directions at the cross-linking point by the addition of monomers. Three types of polymer configurations are produced; a linear and soluble portion called the linear portion; a cross-linked portion which is low in cross-linking density and therefore is soluble in some solvents, such as, tetrahydrofuran, toluene, and the like, and is called sol; and a portion comprising highly cross-linked gel particles which is not substantially soluble in any solvent, for example, tetrahydrofuran, toluene and the like, and is called gel. The second portion with low cross-linking density (sol) is responsible for widening the molecular weight distribution of the soluble part which results in an elevation of the minimum fixing temperature of the toner. Also, a drawback of these processes, which are not carried out under high shear, is that as more cross-linking agent is used the gel particles or very highly cross-linked insoluble polymer with high molecular weight increase in size. The large gels can be more difficult to disperse pigment in, causing unpigmented toner particles during pulverization, and toner developability may thus be hindered. Also, in the case of vinyl polymers, the toners produced often show vinyl offset.

In U.S. Pat. No. 4,533,614 to Fukumoto et al., a process was utilized for preparing loosened cross-linked polyester binder resin which showed low temperature fix and good offset resistance. Metal compounds were used as cross-linking agents. Similar disclosures are presented in U.S. Pat. No. 3,681,106 to Burns et al. and Japanese Laid-open Patent Applications Nos. 94362/1981, 116041/1981 and 166651/1980. As discussed in the '614 patent, incorporation of metal complexes, however, can influence unfavorably the charging properties of the toner.

In U.S. Pat. No. 5,241,020, to Roha, issued Aug. 13, 1993, is disclosed novel blends of polymers produced by polymerization of interactive compounds that form polymers in a non-free radical polymerization, and at least one monomer possessing carbon-to-carbon double bonds capable of polymerization by means of a free radical mechanism, in the presence of reactive initiators. In a preferred mode, a reaction mixture is formed comprising the interactive compounds, the monomers, and the reactive initiators. The interactive compounds are reacted in an initial step to form a first polymer connected to the reactive initiator. In a subsequent reaction free radicals derived from the reactive initiator promote the polymerization of the monomers to form a second polymer. The first polymer forms the continuous phase of the blend, while the second polymer comprises the discontinuous phase. As a consequence of the enhanced inter-phase adhesion resulting from the interaction of the reactive initiators with both polymers, the blends display superior tensile strength, elastic recovery and increased elongation at break.

In U.S. Pat. No. 5,057,392, to McCabe, issued Oct. 15, 1991, is disclosed a low fusing temperature toner powder comprising a polyblend of a crystalline polyester and an amorphous polyester which are crosslinked with an epoxy novolac resin. The crystalline polymer melts at a relatively low temperature and has a relatively low glass transition temperature, while the amorphous polymer has a high glass transition temperature. The crystalline polyester has a number average molecular weight in the range of about 1,000 to about 3,000 and a weight average molecular weight in the range of about 2,000 to about 6,000. The amorphous polyester has a number average molecular weight in the range of about 1,000 to about 3,000 and a weight average molecular weight in the range of about 2,000 to about 9,000.

Thus, there remains a need for toner resins with low fix temperatures and high offset temperatures or wide fusing latitudes, superior or nonexistent vinyl offset property, efficient and economic processes for the preparation of such resins, and the ability to control the gloss levels and gloss properties of the resulting toners and printed images formed therewith.

There is also a need for black or colored toners wherein the aforementioned properties are controllable and preferably selectable during formulation. There is also a need for black and colored toners that are non-blocking, such as from about 115° F. to about 120° F. (46.1° to 48.9° C.), of excellent image resolution, non-smearing, and of excellent triboelectric charging characteristics. In addition, there is a need for black or colored toners with low fusing temperatures, of about 110° C. to about 150° C., of intermediate gloss properties, in embodiments, such as from about 10 to about 25 gloss units, and in other embodiments, from about 40 to about 70 gloss units, of high projection efficiency, such as from about 75 percent efficiency to about 95 percent efficiency or greater, and toner compositions that result in developed images with minimal or no paper curl or fuser roller hot offset.

SUMMARY OF THE INVENTION

It is an object of the present invention to provide simple and economical processes for the preparation of toners with many of the advantages illustrated herein.

It is another object of the present invention, in embodiments, to provide melt blending processes for the preparation of low fix temperature pigmented toner compositions wherein a resin melt mixture comprised of a first polyester resin with a low gloss value, and a second polyester resin with a high gloss value provides a toner resin mixture having an intermediate gloss value which resides between the low and the high gloss values of the separate polyester resin components.

In another object of the present invention is the provision of processes for the preparation of pigmented toner compositions comprising forming a melt mixture comprised of a first polyester resin in an amount of from about 20 to about 80 weight percent of the resin mixture and contains of from about 20 to about 40 weight percent crosslinked gel content and has a gloss value of from about 5 to about 10 gloss units, and a second polyester resin in an amount of from about 80 to about 20 weight percent of the resin mixture and contains from 5 to about 15 weight percent crosslinked gel content and has a gloss value of from about 20 to about 30 gloss units, and wherein the resulting melt blended toner resin mixture has an intermediate gloss value of about 10 to about 25 gloss units.

In another object of the present invention is the provision of processes for the preparation of pigmented toner compositions comprising forming a melt mixture comprised of a first polyester resin in an amount of from about 20 to about 80 weight percent of the resin mixture and contains of from about 20 to about 40 weight percent crosslinked gel content and has a gloss value of from about 5 to about 10 gloss units, and a second polyester resin in an amount of from about 80 to about 20 weight percent of the resin mixture and contains from 0 to about 15 weight percent crosslinked gel content and has a gloss value of from about 20 to about 70 gloss units, and wherein the resulting melt blended toner resin mixture has an intermediate gloss value of about 20 to about 70 gloss units.

Another object of the present invention relates to extrusion processes for the preparation of low melting toner compositions in a continuous operation, and wherein the toner is comprised, in embodiments, of partially crosslinked resins as illustrated herein, such as a thermoplastic resin which can be sufficiently fixed at low temperatures, such as below 200° C. and preferably below 160° C., by hot roll or belt fixing means. Thus, less heat or other source of energy is needed for fixing than for higher fix temperature toner, and therefore, less power is consumed during operation of a copier or printer. The known undesirable paper curl phenomenon may also be reduced, or higher speed of copying and printing may be enabled. Also, the toners formulated possess excellent hot offset resistance, wide fusing latitude and acceptable rheological properties; are inexpensive, safe and economical; and show minimized or substantially no vinyl offset.

In another object of the present invention, there is provided a high gloss low melt toner comprising of a first resin mixture, a second resin mixture, a pigment, and optional performance additives, wherein the toner has a minimum fix temperature of from about 148° to about 170° C., a hot offset temperature of from about 176° to greater than about 220° C., and a fusing latitude of from about 5° to greater than about 43° C., a weight ratio of the first resin mixture to the second resin mixture of about 1:8 to about 1:10, a total crosslinked resin content of about 1 to about 10 percent based on the total weight of resins, and a gloss value for fused images of from about 40 to 70 gloss units.

These and other objects of the present invention are accomplished in embodiments by a continuous or batchwise multi-stage melt blending process comprising melt blending a resin mixture comprised of a first polyester resin with a low gloss value, and a second polyester resin with a high gloss value, to form a toner resin mixture having an intermediate gloss value.

The present invention provides a melt mixing process to produce low cost and safe crosslinked thermoplastic binder resins for toner compositions which have low fix temperatures and high offset temperatures, and which show minimized or substantially no vinyl offset. In this process, unsaturated base polyester resins or polymers are melt blended, that is, in the molten state under high shear conditions in, for example, an extruder or a Banbury rubber mill, producing substantially uniformly dispersed toner constituents, and which process provides a resin blend and toner product with optimized gloss properties which are approximately intermediate between those of starting polyester resins and depend upon the total gel content in the resin mixture.

The present invention provides an economical, robust and reproducible processes for preparing resins for toner, by batch or continuous processes. In embodiments of the present invention, excessive temperatures, for example, above about 200° C., are avoided to preclude thermally induced side reactions such as cross-linking or polymer chain breakage, and which side reactions may adversely affect the imaging properties and quality of the resulting toner composition. Instead, high shear conditions are employed to disperse the melt mixture ingredients to provide a substantially uniform polymer melt and dispersion of toner additives therein and wherein formation of additional crosslinked gel particles, or breakdown of existing crosslinked gel particles is avoided.

In embodiments of the present invention, a resin, referred to as a base resin, for example, an unsaturated linear polyester resin containing from about 20 to about 40 weight percent crosslinked gel content is melt mixed under high temperature and high shear conditions, preferably about 70° to about 160° without forming any significant amounts of residual or undesirable materials. Thus, the removal of byproducts or residual unreacted materials is minimized or eliminated in embodiments of the present invention. In other embodiments of the process, the base polyester resin and a second polyester resin are preblended and fed upstream to a melt mixing device, such as an extruder at an upstream location, or the base resin and second are each fed separately to the melt mixing device, for example, an extruder at either upstream or downstream locations. In an extruder screw configuration, extruder length and temperature control may be used to enable excellent dispersion of the resin mixture and toner additives. Adequate temperature control enables the prevention of cross-linking and degradative side reactions thereby enabling a highly controllable and reproducible melt mixing toner formulation process. Extruder screw configuration and length can also provide high shear conditions that distribute crosslinked gel particle, contained in either one or both, of the polyester resin components well into the polymer melt, and to keep the microgels from inordinately increasing in size with increasing degree of cross-linking. An optional devolatilization zone may be used to remove any volatiles, if desired. The resulting polymer melt blend containing a partially crosslinked resin fraction may then be pumped through a die to a pelletizer.

The process of the present invention can be utilized to produce a low cost, safe partially crosslinked toner resin and toner compositions which possess substantially no residual byproducts such as increased cross-linking or resin degradation, which can be sufficiently fixed at low temperature by hot roll or belt fixing to afford energy saving, are particularly suitable for high speed fixing, show excellent offset resistance and wide fusing latitude, for example, low fix temperature and high offset temperature, and show minimized or no vinyl offset.

The crosslinked gel content of the resin melt mixtures and the resulting toner compositions of the present invention, in embodiments, can be preselected and controlled, for example, by a formulating operator or robotically at the outset of the process, and wherein the crosslinked gel content is substantially maintained at a constant level throughout the process. This enables a high level of control over the gloss properties of the resulting toner composition. Thus, crosslink gel content and density variations are minimized in the present invention. If uncontrolled, gel content and density variations can influence toner melt rheology such as toner melt flow, offset and fix properties, and the light scattering properties of the fixed toner images as manifested for example, as gloss or matte finishes. The ratio of base resin to the second polyester resin can be readily adjusted throughout the melt blend process to additionally control the glass transition ($T_g$) temperature of the final polymer blend and to a great extent the gloss properties of the resultant toner.

DETAILED DESCRIPTION OF PREFERRED EMBODIMENTS

Figure 1:
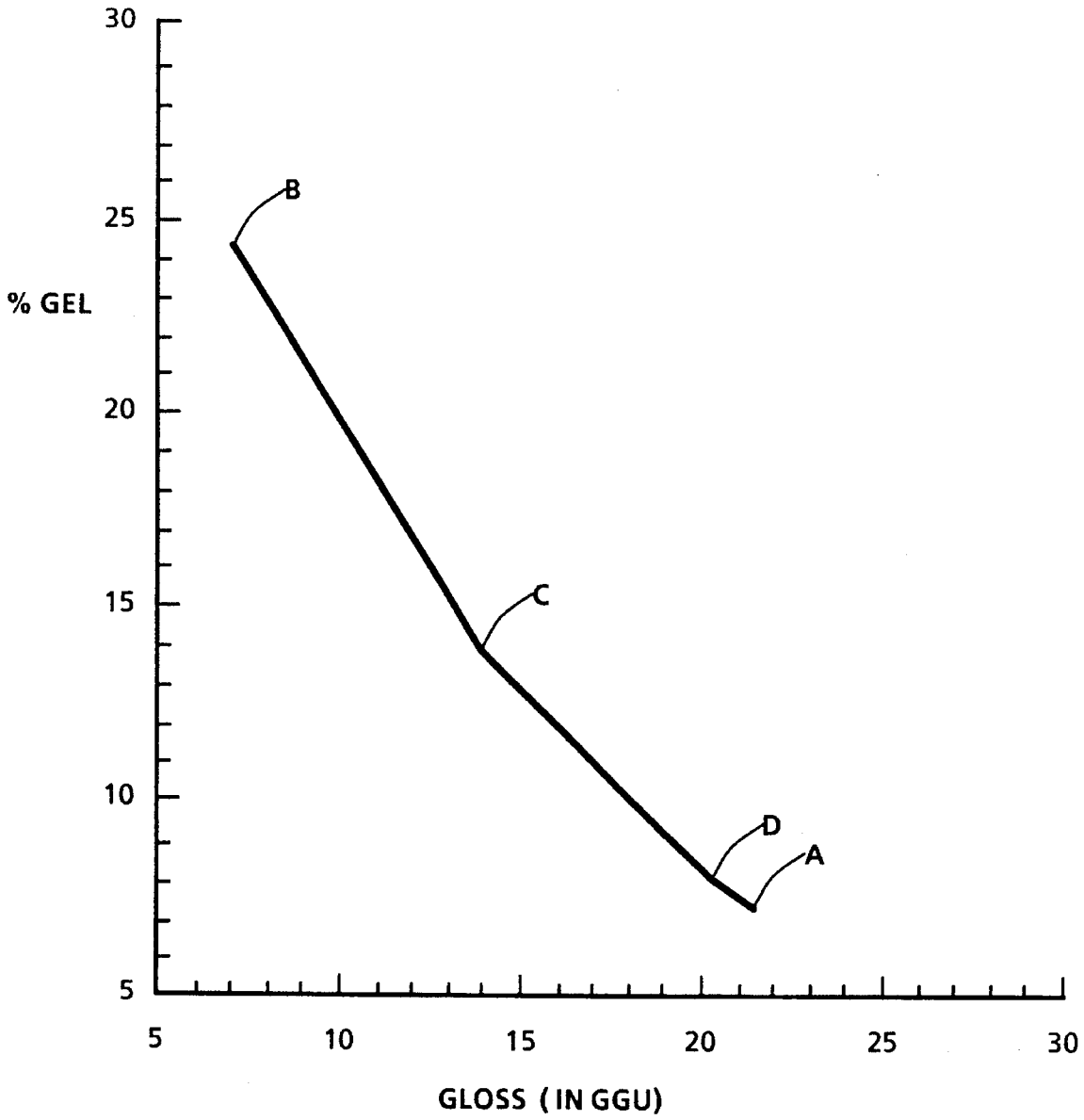
FIG. 1 illustrates the effect of crosslinked gel content levels in toner resin blends on the gloss properties measured in Gardner Gloss Units of the fixed toner images measured at 0.74 toner mass per unit area of the present invention.

The present invention provides a process for fabricating low fix temperature toner resins by non-reactive melt mixing in any melt mixing device, batch or continuous, but preferably continuous such as, for example, an extruder wherein a first partially crosslinked polyester base resin with a low gloss value is melt mixed with a second polyester resin with a high gloss value, under high shear conditions, to form a toner resin mixture having an intermediate gloss value, and preferably wherein the first polyester resin is present in an amount of from about 20 to about 80 weight percent of the resin mixture and contains of from about 20 to about 40 weight percent crosslinked gel content and has a gloss value of from about 5 to about 10 gloss units, and the second polyester resin is present in an amount of from about 80 to about 20 weight percent of the resin mixture and contains from 5 to about 15 weight percent crosslinked gel content and has a gloss value of from about 20 to about 30 gloss units, and wherein the resulting melt blended toner resin mixture has an intermediate gloss value of about 10 to about 25 gloss units. The term "non-reactive" as used herein means substantially no increase in gel content or no increase resin molecular weight is observed during the melt mixing or blending of the polyester resins and toner components, while small amounts of gel breakdown and minor decreases in molecular weight as a result of the high shear melt mixing step, may be observed. In another embodiment, the first polyester resin is present in an amount of from about 20 to about 80 weight percent of the resin mixture and contains of from about 20 to about 40 weight percent crosslinked gel content and has a gloss value of from about 5 to about 10 gloss units, and the second polyester resin is present in an amount of from about 80 to about 20 weight percent of the resin mixture and contains from 0 to about 15 weight percent crosslinked gel content and has a gloss value of from about 20 to about 75 gloss units, and wherein the resulting melt blended toner resin mixture has an intermediate gloss value of about 10 to about 70 gloss units. Toner resins prepared by a process related to the present invention are disclosed in detail in the aforementioned U.S. Pat. No. 5,227,460, the disclosure of which is hereby totally incorporated herein by reference.

Low fix temperature toner resins are formulated in embodiments by a melt mixing process comprising: melt mixing under high shear, at a temperature of about 70° to about 160° C., a base polyester resin containing a partially crosslinked polyester fraction, and a second polyester resin which contains a partially crosslinked polyester fraction, or preferrably the second polyester resin contains essentially only linear unsaturated and uncrosslinked resin with molecular weight properties which are different from the base polyester resin mixture, thereby forming a polymer melt; and thereafter cooling, crushing, grinding, and classifying the toner composition into suitably sized toner particles.

In a preferred embodiment, a low fix temperature toner resin mixture is formulated by a process comprising preblending a first polyester base resin containing from about 20 to about 35 weight percent of crosslinked gel, a second polyester resin containing from 0 to about 15 weight percent of crosslinked gel, and optional toner additives, such as carbon black, colored pigments and charge additives; feeding the mixture to an extruder; gently heating the mixture at a temperature above the glass transition temperature of the base resin component and the second resin component, for example, above about 70° C. but below a temperature above which the the unsaturated polyester component begins to undergo thermally induced crosslinking or degradation reactions, such as above about 200° C., to obtain a melt mixture of the first and second polyester resins and to further disperse the optional additives therein while avoiding significant thermal degradation or crosslinking; keeping the melt mixture in the extruder for a sufficient residence time for example, 10 seconds to about 10 minutes, at a given temperature such that the required amount of mixing and dispersion is achieved; providing sufficiently high shear during the melt mixing thereby keeping any crosslinked gel particles originally present in the mixture small in size and well distributed in the polymer melt; optionally devolatilizing the melt to remove any effluent volatiles; and pumping the cross-linked resin melt mixture through a die to a pelletizer. The weight ratio of the first polyester to the second polyester, in embodiments, is from about 1:3 to about 3:1 depending upon the gloss and fusing properties desired. The resulting solidified toner mixture can then be pulverized and classified to obtain particles of desirable size and distribution. The solidified toner can be directly reextruded as a solid mass or subsequent to pulverization and classification into particles.

The pigmented toner composition that results from dispersive melt mixing or blending in the present process invention contains resin which is comprised of mixtures of crosslinked or gel portions or mixtures of crosslinked and linear portions. The crosslinked portions comprise very high molecular weight densely crosslinked microgel particles having average diameter less than about 0.1 micron and are insoluble in substantially most any solvent, including tetrahydrofuran, toluene, and the like solvents, and macrogel particles having average diameter greater than about 0.1 micron. The linear portion comprises lower molecular weight resin molecules which are soluble in various solvents such as, for example, tetrahydrofuran, toluene and the like. The high molecular weight highly crosslinked gel particles are preferrably substantially uniformly distributed within the linear or uncrosslinked resin portions upon completion of the melt blending.

In the process of the present invention, the fabrication of gloss controllable resin and toner compositions thereof may be carried out in a melt mixing device such as an extruder described in U.S. Pat. No. 4,894,308 to Mahabadi et al., the disclosure of which is hereby totally incorporated herein by reference. Generally, any high shear, temperature controllable melt mixing device suitable for processing polymer melts may be employed, provided that the objectives of the present invention are achieved. Examples of continuous melt mixing devices include single screw extruders or twin screw extruders, continuous internal mixers, gear extruders, disc extruders and roll mill extruders. Examples of batch internal melt mixing devices include Banbury mixers, Brabender mixers, and Haake mixers.

One suitable type of extruder is the fully intermeshing co-rotating twin screw extruder such as, for example, the ZSK series of twin screw extruders available from Werner & Pfleiderer Corporation, Ramsey, N.J., U.S.A. For example, a small ZSK-40 twin screw extruder has a screw diameter of 40 millimeters and a length-to-diameter (L/D) ratio of 52.5. The extruder can melt the base resin, disperse optional toner additives and colorants into the uncrosslinked or partially crosslinked resins, optionally devolatilize the melt to remove any effluent volatiles if needed, and pump the melt through a die such as, for example, a strand die to a pelletizer.

With reference to FIG. 1, there is shown the effect of crosslinked gel content levels in toner resin blends on the gloss properties measured in Gardner Gloss Units (GGU) of fixed toner images measured at 0.74 toner mass per unit area (milligrams per square centimeter) at 370° F. (188° C.). Composition "A" is a toner comprised of an unblended 7 percent by weight gel containing crosslinked polyester which has a relatively high gloss value of about 22 GGU. Composition "B" is a toner comprised of an unblended 30 percent by weight gel containing crosslinked polyester which has a relatively low gloss value of about 7 GGU. Composition "C" is a toner comprised of a 2:1 weight ratio of the 30 percent by weight gel containing crosslinked polyester and 7 percent by weight gel containing crosslinked polyester and a total gel content of about 14 weight percent. This blended toner has an intermediate gloss value of about 14 GGU and which gloss is approximately midway between the unblended toner compositions "A" and "B" Composition "D" is a toner comprised of a 1:2 weight ratio of the 30 percent by weight gel containing crosslinked polyester and 7 percent by weight gel containing crosslinked polyester, respectively, with a total gel content of about 9 percent by weight. This blended toner has a gloss value of about 20 GGU, and is also an intermediate gloss value between the unblended toner compositions "A" and "B".

Figure 2:
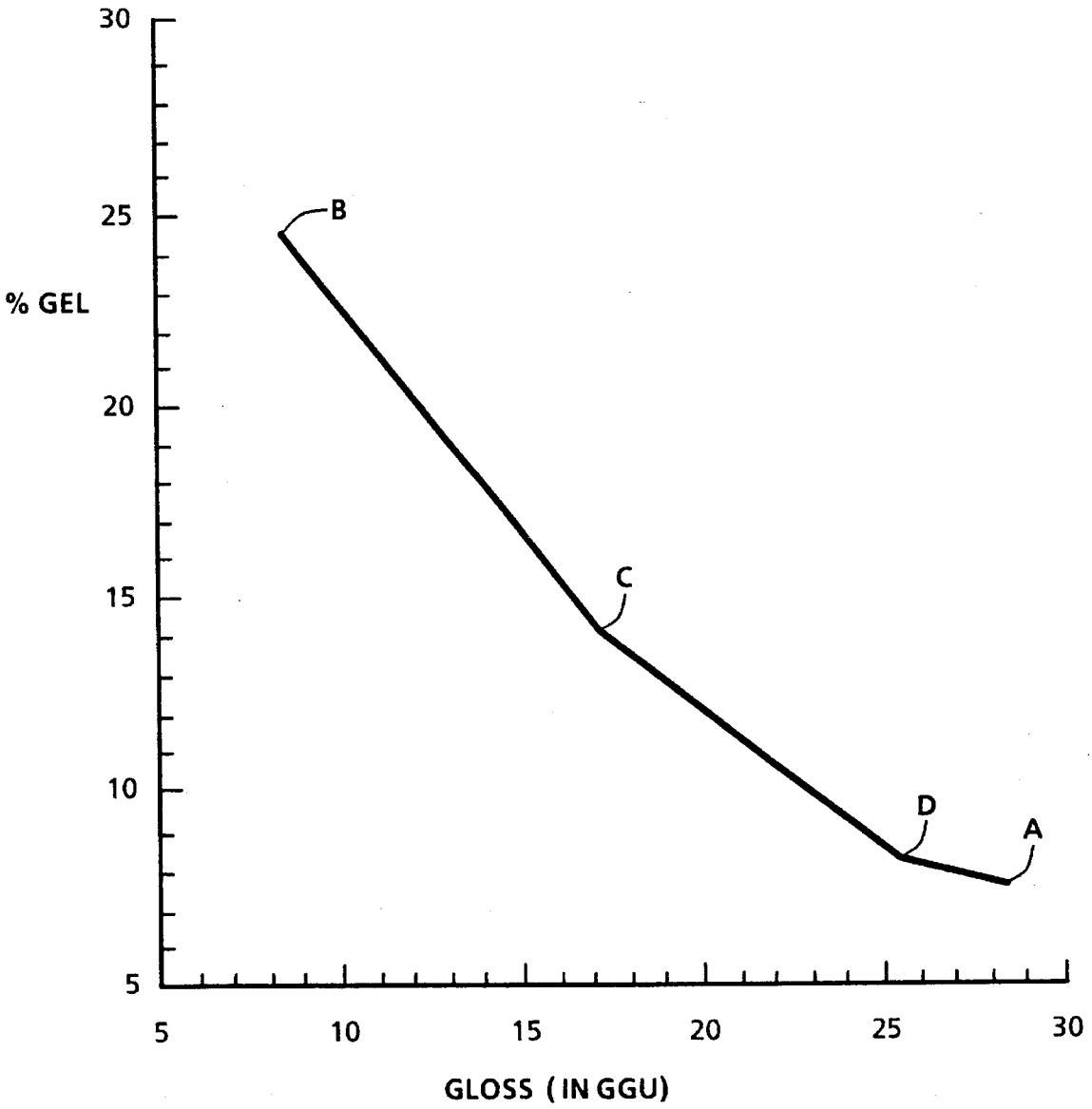
FIG. 2 illustrates the effect of crosslinked gel content levels in toner resin blends on the gloss properties measured in Gardner Gloss Units of the fixed toner images measured at 1.05 toner mass per unit area of the present invention.

With further reference to FIG. 2, there is shown another example of the effect of crosslinked gel content levels in toner resin blends on the gloss properties measured in Gardner Gloss Units of fixed toner images measured at 1.05 toner mass per unit area at 370° F. (188° C. ). Composition "A" is a toner comprised of an unblended 7 percent by weight gel containing crosslinked polyester which has a relatively high gloss value of about 28 GGU. Composition "B" is a toner comprised of an unblended 30 percent by weight gel containing crosslinked polyester which has a relatively low gloss value of about 8 GGU. Composition "C" is a toner comprised of a 2:1 weight ratio of the 30 percent by weight gel containing crosslinked polyester and 7 percent by weight gel containing crosslinked polyester, respectively, and a total gel content of about 14 weight percent. This toner has an intermediate gloss value of about 16 GGU and is an intermediate gloss value between the unblended toner compositions "A" and "B" Composition "D" is a toner comprised of a 1:2 weight ratio of the 30 percent by weight gel containing crosslinked polyester and 7 percent by weight gel containing crosslinked polyester, respectively, and a total gel content of about 8 weight percent, and which toner has an intermediate gloss value of about 25, which is intermediate between the unblended toner compositions "A" and "B".

Figure 3:
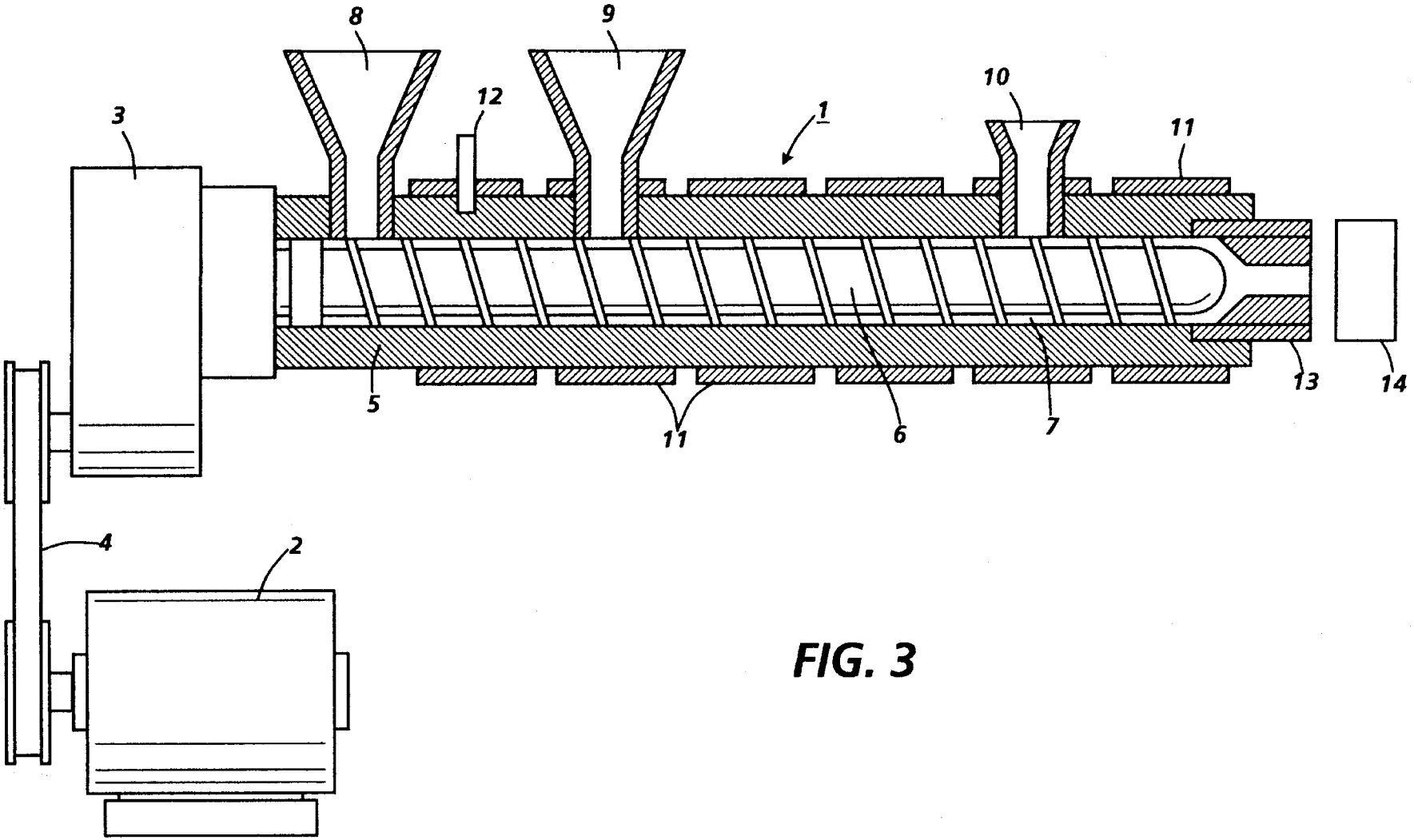
FIG. 3 is a partial schematic cross-sectional view of an extrusion apparatus suitable for the processes of the present invention.

For a better understanding of the present invention, a typical extrusion apparatus suitable for the process of the present invention is illustrated in FIG. 3. FIG. 3 shows a twin screw extrusion device 1 containing a drive motor 2, a gear reducer 3, a drive belt 4, an extruder barrel 5, a screw 6, a screw channel 7, an upstream supply port or hopper 8, a downstream supply port 9, a downstream devolatilizer 10, a heater 11, a thermocouple 12, a die or head pressure generator 13, and a pelletizer 14. The barrel 5 consists of modular barrel sections, each separately heated with heater 11 and temperature controlled by thermocouple 12. With modular barrel sections, it is possible to locate feed ports and devolatilizing ports at required locations, and to provide segregated temperature control along the screw channel 7. The screw 6 is also modular, enabling the screw to be configured with modular screw elements and kneading elements having the appropriate lengths, pitch angles, and the like, in such a way as to provide optimum conveying, mixing, reaction, devolatilizing and pumping conditions.

In operation, the components to be non-reactively blended and extruded, for example, the base resin and the second polyester resin component, enter the extrusion apparatus from the first upstream supply port 8 and/or second downstream supply port 9. The base resin and the second polyester resin component, usually in the form of solid pellets, chips, granules, or other forms can be fed to the first upstream supply port 8 and optionally to second downstream supply port 9 by starve feeding, gravity feeding, volumetric feeding, loss-in-weight feeding, or other known feeding methods. Heating takes place from two sources: (1) external barrel heating from heaters 11, and (2) internal heating from viscous dissipation and shear within the polymer melt itself. The rotational speed of the extruder screw preferably ranges from about 50 to about 500 revolutions per minute. If needed, volatiles may be removed through downstream devolatilizer 10 by applying a vacuum. At the end of screw channel 7, the cross-linked resin is pumped in molten form through die 13, such as for example a strand die, to pelletizer 14 such as, for example, a water bath pelletizer, underwater granulator, etc.

With further reference to FIG. 3, the rotational speed of the screw 6 can be of any suitable value provided that the objectives of the present invention are achieved. Generally, the rotational speed of screw 6 is from about 50 revolutions per minute to about 500 revolutions per minute. The barrel temperature, which is controlled by thermocouples 12 and generated in part by heaters 11, is from about 70° C. to about 160° C., and preferrably from about 90° C. to about 110° C. The temperature range for mixing the base resin and second polyester resin mixture and optional additives in the upstream barrel zones is from about the melting temperature of the base resin to below the cross-linking onset temperature, and preferably within about 40° C. of the melting temperature of the base resin. For example, for an unsaturated polyester base resin the temperature is preferably about 90° C. to about 130° C. The die or head pressure generator 13 generates pressure from about 50 pounds per square inch to about 500 pounds per square inch. In one embodiment, the screw is allowed to rotate at about 100 revolutions per minute, the temperature along barrel 5 is maintained at about 70° C. in the first barrel section and 160° C. further downstream, and the die pressure is about 50 pounds per square inch.

When melt mixing in a batch internal melt mixing device, the residence time is preferably in the range of about 10 seconds to about 10 minutes. The rotational speed of a rotor in the device is preferably about 10 to about 500 revolutions per minute.

Thus, in a process of the present invention, a base resin and a second polyester resin in admixture with optional toner additives, are fed to a melt mixing apparatus and non-reactive melt mixing is carried out at low to moderate temperatures and specified above and at high shear to produce a resin blend which enables the preparation of low fix temperature toners with good fusing latitude and low vinyl offset properties, and intermediate gloss properties as illustrated herein.

The base resin used in the process of this invention is a polymer, preferably a linear polymer such as a linear unsaturated polyester. In preferred embodiments, the base resin has a degree of unsaturation of about 0.1 to about 65 mole percent, preferably about 1 to about 50 mole percent. In a preferred embodiment, the linear unsaturated polyester base resin is characterized by number-average molecular weight (Mn) as measured by gel permeation chromatography (GPC) in the range typically from 1,000 to about 20,000, and preferably from about 2,000 to about 5,000, weight average molecular weight (Mw) in the range typically from 2,000 to about 40,000, and preferably from about 4,000 to about 15,000. The molecular weight distribution (Mw/Mn) is in the range typically from about 1.5 to about 6, and preferably from about 2 to about 4. The onset glass transition temperature ($T_g$) for the base resin as measured by differential scanning calorimetry (DSC) is in the range typically from 50° C. to about 70° C., and preferably from about 51° C. to about 60° C. Melt viscosity as measured with a mechanical viscometer at 10 radians per second is from about 5,000 to about 20,000 poise, and preferably from about 10,000 to about 100,000 poise, at 100° C. and drops sharply with increasing temperature to from about 100 to about 5,000 poise, and preferably from about 250 to about 2,000 poise, as temperature rises from 100° C. to 130° C.

Linear unsaturated polyesters used as the base resin are, in embodiments, low molecular weight condensation polymers which may be formed by the step-wise reactions between both saturated and unsaturated diacids, diesters or anhydrides and dihydric alcohols such as glycols or diols. The resulting unsaturated polyesters are reactive, that is cross-linkable, in two respects: (i) unsaturation sites (double bonds) along the polyester backbone chain; and (ii) functional groups such as carboxyl, hydroxy, and the like, groups amenable to acid-base or condensation reactions. Typical unsaturated polyesters useful for this invention are prepared by melt polycondensation or other polymerization processes using diacids, diesters and/or anhydrides and diols. Suitable diacids and anhydrides include but are not limited to saturated diacids and/or anhydrides such as, for example, succinic acid, glutaric acid, adipic acid, pimelic acid, suberic acid, azelaic acid, sebacic acid, isophthalic acid, terephthalic acid, hexachloroendomethylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like, diesters derived therefrom and mixtures thereof; and unsaturated diacids and/or anhydrides such as, for example, maleic acid, fumaric acid, chloromaleic acid, itaconic acid, citraconic acid, mesaconic acid, maleic anhydride,, diesters thereof, and the like, and mixtures thereof. Suitable diols include, but are not limited to, for example, propylene glycol, ethylene glycol, diethylene glycol, neopentyl glycol, dipropylene glycol, dibromoneopentyl glycol, propoxylated bisphenol-A, ethoxylated bisphenol-A, 2,2,4-trimethylpentane-1,3-diol, tetrabromo bisphenol dipropoxy ether, 1,4-butanediol, 1,3 butanediol, and the like, and mixtures thereof, soluble in highly dissolving solvents such as, for example, tetrahydrofuran, toluene, and the like.

Preferred linear unsaturated polyester base resins are prepared from diacids, diesters and/or anhydrides such as, for example maleic anhydride, fumaric acid, and the like and mixtures thereof, and diols such as, for example, propoxylated bisphenol-A, propylene glycol,1,3 butanediol, and the like, and mixtures thereof. A particularly preferred polyester is poly(propoxylated bisphenol A fumarate).

Substantially any suitable unsaturated polyester can be used in the process of the invention, including unsaturated polyesters known for use in toner resins and including unsaturated polyesters whose properties previously made them undesirable or unsuitable for use as toner resins but which adverse properties are eliminated or reduced by introducing a crosslinked gel component therein and thereafter forming a melt mixture with a second polyester resin component as illustrated herein. Other suitable unsaturated polyester compounds are disclosed in "UNSATURATED POLYESTERS: STRUCTURE AND PROPERTIES", by Herman V. Boenig, p. 17, Elsevier Publishing Co., New York, (1964), and the aforementioned commonly owned U.S. Pat. No. 5,227,460, the disclosures of which are incorporated by reference herein in their entirety.

Any appropriate initiation technique for cross-linking may be used to introduce the crosslinked content into the base resin or into the second polyester resin prior to melt mixing the base resin and the second resin to prepare the toner compositions of the present invention. Crosslinking techniques and processes suitable for preparing partially crosslinked resin mixtures for use in the present invention are described in the aforementioned commonly assigned U.S. Pat. No. 4,894,308 and copending application U.S. Ser. No. 08/393,606, the disclosures of which are incorporated by reference herein in their entirety. Free radical initiators such as, for example, organic peroxides or azo compounds are preferred for this process. Suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di (2-ethyl hexanoyl peroxy) hexane. Suitable azo compounds include 2,2'-azobis(isobutyronitrile), 2,2'-azobis (2,4-dimethyl valeronitrile), 2,2'-azobis(methyl butyronitrile), 1,1'-azobis(cyano cyclohexane) and other similar known compounds.

Minor amounts, of less than about 10 percent of the resin content, of a diluent resin may be employed to provide improved compatibility, hot melt flowability, and the like properties. For example, useful diluent resins include resins or waxes without olefinic double bonds, carboxylic acids or hydroxyl groups, other functional groups which are not readily abstracted by free radical species under the conditions of the present process, and are selected from the group consisting of methyl terpolymer, a polyvinylidine fluoride, a polymethyl methacrylate, hydrogenated poly(styrene-butadiene), polyisobutylmethacrylate, polyacrylate, polymethacrylate, polystyrene, polystyrene acrylate, polystyrene methacrylate, polyvinyl chloride, a wax component with a weight average molecular weight from about 1,000 to about 6,000, and mixtures thereof, for example, mixtures of from 2 to 4 diluent resin or wax components.

The crosslinked portions of the partially crosslinked resin component can consist essentially of very high molecular weight microgel particles with high density crosslinking as measured by gel content and which are not soluble in substantially any solvents such as, for example, tetrahydrofuran, toluene, and the like. The microgel particles are highly crosslinked polymers with a short cross-link interpolymeric separation distances.

The linear portions of the partially crosslinked resin component or components have number average molecular weight (Mn), weight average molecular weight (Mw), molecular weight distribution (Mw/Mn), onset glass transition temperature ($T_g$) and melt viscosity substantially the same as the base resin without crosslinked gel content.

In embodiments, the partially crosslinked unsaturated polyester base resin when melt blended with a second unsaturated polyester enables the preparation of toners with minimum fix temperatures in the range of about 100° C. to about 200° C., preferably about 100° C. to about 160° C., more preferably about 110° C. to about 150° C. Also, these low fix temperature toners have fusing latitudes ranging from about 10° C. to about 120° C. and preferably more than about 20° C. and more preferably more than about 30° C. Processes of the invention can produce toner resins and thus toners with minimized or substantially no vinyl offset.

The melt mixed resin blends of the present invention have the important rheological property of allowing a toner prepared therefrom to show low fix temperature and high offset temperature. The low fix temperature is believed to be a function of the molecular weight and the molecular weight distribution of the linear portion, and is not believed to be significantly affected by the amount of microgel or degree of cross-linking in the resin.

In addition to rendering a unique rheological property to the toner resin not attainable in conventional crosslinking processes for preparing toner resins, the melt mixing processes of the present invention have several other important advantages. By choosing the type and molecular weight properties of the base resin, the minimum fix temperature can be easily manipulated. The hot offset temperature can also be easily manipulated by controlling the gel content in the partially crosslinked resin which can be in turn be regulated by the amount of free radical initiator, and vinyl monomer used in preparing the starting crosslinked resin materials. Thus, it is possible to produce a series of resin blends and thus toners with operator selectable gloss properties.

The blended resins are generally present in the toner in an amount of from about 40 to about 98 percent by weight, and more preferably from about 70 to about 98 percent by weight, although they may be present in greater or lesser amounts, provided that the objectives of the invention are achieved. For example, toner resin produced by the process of the invention can be subsequently melt blended or otherwise mixed with a colorant, charge carrier additives, surfactants, emulsifiers, pigment dispersants, flow additives, and the like. The resultant product can then be pulverized by known methods such as milling to form toner particles. The toner particles preferably have an average volume particle diameter of about 5 to about 25, more preferably about 5 to about 15 microns.

Various suitable colorants can be employed in toners of the invention, including suitable colored pigments, dyes, and mixtures thereof including carbon black, such as Regal 330®carbon black (Cabot), Acetylene Black, Lamp Black, Aniline Black, Chrome Yellow, Zinc Yellow, Sicofast Yellow, Luna Yellow, Novaperm Yellow, Chrome Orange, Bayplast Orange, Cadmium Red, Lithol Scarlet, Hostaperm Red, Fanal Pink, Hostaperm Pink, Lithol Red, Rhodamine Lake B, Brilliant Carmine, Heliogen Blue, Hostaperm Blue, Neopan Blue, PV Fast blue, Cinquassi Green, Hostaperm Green, titanium dioxide, cobalt, nickel, iron powder, Sicopur 4068 FF, and iron oxides such as Mapico Black (Columbia), NP608 and NP604 (Northern Pigment), Bayferrox 8610 (Bayer), MO8699 (Mobay), TMB-100 (Magnox), mixtures thereof and the like.

The colorant, preferably carbon black, cyan, magenta and/or yellow colorant, is incorporated in an amount sufficient to impart the desired color to the toner. In general, pigment or dye is employed in an amount ranging from about 2 to about 60 percent by weight, and preferably from about 2 to about 7 percent by weight for color toner and about 3 to about 50 percent by weight for black toner.

Various known suitable effective positive or negative charge enhancing additives can be selected for incorporation into the toner compositions produced by the present invention, preferably in an amount of about 0.1 to about 10, more preferably about 1 to about 3, percent by weight. Examples include zinc stearate quaternary ammonium compounds inclusive of alkyl pyridinium halides; alkyl pyridinium compounds, reference U.S. Pat. No. 4,298,672, the disclosure of which is totally incorporated hereby by reference; organic sulfate and sulfonate compositions, U.S. Pat. No. 4,338,390, the disclosure of which is totally incorporated hereby by reference; cetyl pyridinium tetrafluoroborates; distearyl dimethyl ammonium methyl sulfate; aluminum salt complexes such as Bontron E84™ or E88™ (Hodogaya Chemical); and the like.

Additionally, other internal and/or external additives may be added in known amounts for their known functions.

The resulting toner particles optionally can be formulated into a developer composition by mixing with carrier particles. Illustrative examples of carrier particles that can be selected for mixing with the toner composition prepared in accordance with the present invention include those particles that are capable of triboelectrically obtaining a charge of opposite polarity to that of the toner particles. Accordingly, in one embodiment the carrier particles may be selected so as to be of a negative polarity in order that the toner particles which are positively charged will adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the entire disclosure of which is hereby totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby totally incorporated hereby by reference.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluoroethylenes, other known coatings and the like.

The diameter of the carrier particles is generally from about 50 microns to about 1,000 microns, preferably about 200 microns, thus allowing these particles to possess sufficient density and inertia to avoid adherence to the electrostatic images during the development process. The carrier particles can be mixed with the toner particles in various suitable combinations. Best results are obtained when about 1 part carrier to about 10 parts to about 200 parts by weight of toner are mixed.

Toners produced by the process of the invention can be used in known electrostatographic imaging methods, although the fusing energy requirements of some of those methods can be reduced in view of the advantageous fusing properties of the subject toners as discussed herein. Thus, for example the toners or developers can be charged, for example, triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll at a temperature lower than 200° C., preferably lower than 150° C.

The invention will further be illustrated in the following, non-limiting examples, it being understood that these examples are intended to be illustrative only and that the invention is not intended to be limited to the materials, conditions, process parameters and the like recited herein. Parts and percentages are by weight unless otherwise indicated.

EXAMPLE I

Preparation of a 7 Weight Percent Gel Content Resin.

A 7 weight percent partially crosslinked polyester was prepared by mixing 0.5% by weight benzoyl peroxide with 99.5% by weight of an unsaturated polyester resin HETRON 3091T, available from Ashland Chemical Company as follows. The dry mixture was tumble blended at room temperature for about 30 minutes to ensure proper mixing before crosslinking by reactive extrusion. The processing conditions were as follows: Extruder (Model GSK-40) with a barrel temperature profile of 40/40/180/180/180/180/180/180/180/150/150° C.; Screw Speed: 300 rpm; and Feed Rate: 300 lb/hr. The partially crosslinked resin obtained had a melt index of 9.1g/10 min measured at 117° C., using 2.16 kg weight and a gel content of 7 weight percent as measured by GPC and filtration methods.

TONER A: Preparation of a 7 Weight Percent Gel Content Toner.

A toner was prepared by tumble blending for 30 minutes at room temperature a mixture of 95% weight percent of the above resin containing about 7 weight percent partially crosslinked polyester with about 5 weight percent Regal® 330 carbon black. The dry mixture was then melt mixed in an extruder as follows: Extruder (Model GSK-40) with a barrel temperature profile of 90/90/90/90/90/90/90/90/90/90/90/110° C.; screw speed: 240 rpm; feed rate: 200 lb/hr; and water injection: 3 weight percent.

The resultant toner was evaluated for fusing performance and image gloss in accordance with the general procedures disclosed in the aforementioned commonly owned U.S. Pat. No. 5,376,494. The image gloss was 28 Gardner Gloss Unit at 370° F. and at 1.05 developed toner mass per unit area (TMA, in milligrams per square centimeter). This toner provided a fuser a roll life of only 16,200 prints prepared on, for example, a Xerox Corporation Model 5090 machine.

EXAMPLE II

Preparation of a 30 Weight Percent Gel Content Resin.

A 30 weight percent partially crosslinked polyester was prepared by mixing 1.0% by weight benzoyl peroxide with 99.0% by weight of an unsaturated polyester resin, Hetron 3091T available from Ashland Chemical Company as follows. The dry mixture was tumble blended at room temperature for about 30 minutes to ensure proper mixing before crosslinking. The processing conditions were as follows: Extruder (Model GSK-40) with a barrel temperature profile of 40/40/170/170/170/170/170/170/170/150/150° C.; screw speed of 300 rpm; and feed rate of 300 lb/hr. The partially crosslinked resin obtained had a melt index of 6.3g/10 min measured at 117° C., using 16.6 kg weight, and a gel content of 30 weight percent.

TONER B: Preparation of a 30 Weight Percent Gel Content Toner.

A toner was prepared with the above partially crosslinked 30 weight percent gel content resin by tumble blending for 30 minutes at room temperature a mixture of 95% weight percent of the above 30 weight percent partially crosslinked polyester resin and 5 weight percent Regal® 330 carbon black. The dry mixture was then melt mixed in an extruder as follows: Extruder (Model ZSK-40) with a barrel temperature profile of 120/120/120/90/90/90/90/90/90/90/90/110° C.; screw speed of 240 rpm; feed rate of 200 lb/hr; and water injection of 3 weight percent.

The resultant toner was evaluated for fusing performance and image gloss. The image gloss was 8.3 Gardner Gloss Units at 370° F. and at 1.05 TMA. This toner provided a fuser a roll life of greater than 81,000 prints, at which time the test was terminated.

EXAMPLE III

TONER C: Preparation of Intermediate Image Gloss Toner by Blending Low and High Gel Content Resins.

A toner with intermediate gloss properties was prepared as follows. A mixture of 63 percent by weight of high gel content HETRON 3091T resin from Example II and 32 percent by weight of low gel content HETRON 3091T resin from Example I were tumbled blended with 5 weight percent Regal® 330 carbon black for 30 minutes. The mixture was then melt mixed in an extruder at the following conditions: Extruder (Model GSK-28) with a barrel temperature profile: 120/115/115/115/115° C.; screw speed: 250 rpm; and feed rate: 6 lb/hr.

The resultant toner with a gel content of about 14 weight percent was evaluated for fusing performance and had a image gloss of about 17 Gardner Gloss units at 370° F. and at 1.05 TMA. This gloss is approximately intermediate between the 8.3 and the 28 of the toners mixtures formed in Example I and II, respectively. Thus, it is possible to readily obtain a large number of toners with intermediate gloss values by properly blending various ratios of two different resins or toners which have different crosslinking levels and different gloss levels.

EXAMPLE IV

TONER D: Preparation of Intermediate Image Gloss Toner by Blending Low and High Gel Content Resins.

A toner with intermediate gloss properties was prepared as follows. A mixture of 32 percent by weight of high gel content HETRON 3091T resin from Example II and 63 percent by weight of low gel content HETRON 3091T resin from Example I were tumbled blended with 5 weight percent Regal® 330 carbon black for 30 minutes. The mixture was then melt mixed in an extruder at the following conditions: Extruder (Model GSK-28) with a barrel temperature profile: 120/115/115/115/115° C.; screw speed: 250 rpm; and feed rate: 6 lb/hr.

The resultant toner with a gel content of about 8 weight percent was evaluated for fusing performance and had a image gloss of about 25 Gardner Gloss units at 370° F. and at 1.05 TMA. The gloss is an intermediate value between the 8.3 and the 28 of the toners mixtures formed in Example land II, respectively.

The toners prepared in Example I to IV had a minimum fix temperature of about 330° F. (170° C.) and did not show any hot offset initially a temperatures up to 415° F. (213° C.), the highest temperature before permanent damage to the fuser rubber will occur. However, the fusing latitude of over 85° F. (41° C.) decreases with time, the rate of which depends upon the degree of stress applied to the rolls. Roll failure occurs when hot offset occurs at the operating temperatures of about 360° F. (182° C. ). The gel content, gloss, minimum fix temperature (MFT), hot offset temperature (HOT), and fusing latitude (FL) results for the toners prepared in Examples I–IV are summarized in Table 1.

TABLE 1

| Toner Sample | Linear Content Wt. % | Gel Content Wt. % | Garder Gloss Units | MFT °C. | HOT °C. | FL °C. |
|---|---|---|---|---|---|---|
| Toner A | 93 | 7 | 28 | 168 | >213 | >45 |
| Toner B | 70 | 30 | 8.3 | 172 | >213 | >41 |
| Toner C | 86 | 14 | 17 | 170 | >213 | >43 |
| Toner D | 92 | 8 | 25 | 170 | >213 | >43 |

EXAMPLE V

Preparation of Toner with Image Gloss of from about 40 to about 70 Gardner Gloss Units An unsaturated polyester resin, RESAPOL HT available from Rasana Co. (Brazil), Mw=15,600 and Mn=6,800, having a similar structure but with a higher molecular weight compared to commercially available SPAR-II (available from Goodyear Co., Mw=13,200, Mn=6,400), was crosslinked to about a 36.5 weight percent gel content and formulated substantially in accordance with resin and toner of Example II with the exception that the pigment used was PV Fast Blue at 3.3 weight percent rather than carbon black. A series of toners were then prepared by melt blending this crosslinked resin component with varying amounts of the starting uncrosslinked polyester resin and pigment such that the final gel levels of the resulting toners were 3, 5, 7, and 9 weight percent, respectively. A toner containing zero (0%) weight percent crosslinked polyester was also prepared and exhibited the highest gloss value in the series. The observed image gloss at 188° C. (370° F. ) and respective gel content of the toners are listed in the accompanying Table 2. The developed images were fused as in the preceding examples or by employing a fusing system and monoamino functional silicone release agent as disclosed in the aforementioned copending U.S. Ser. No. 08/314,759 and 08/315,006. The resulting high gloss color images had pictorial color qualities.

TABLE 2

| 36.5% gel Crosslinked RESAPOL HT | RESAPOL HT | Gel Level In Toner (Wt %) | Image Gloss at 188° C. |
|---|---|---|---|
| 0% | 96.7% | 0 | 73 |
| 8.2 | 88.5 | 3% | 66 |
| 13.7 | 83.0 | 5% | 62 |
| 19.2 | 77.5 | 7% | 61 |
| 24.7 | 72.0 | 9% | 58 |

The disclosures of all the above mentioned patents and publications mentioned herein are incorporated by reference in their entirety.

Other modifications of the present invention may occur to those skilled in the art subsequent to a review of the present application. The aforementioned modifications, including equivalents thereof, are intended to be included within the scope of the present invention.

What is claimed is:

1. A process for preparing low fix temperature toner mixture comprising melt blending a colorant, and a resin mixture comprised of a first polyester resin with a low gloss value, and a second polyester resin with a high gloss value, wherein the first polyester resin is present in an amount of from about 20 to about 80 weight percent of the resin mixture and contains of from about 20 to about 40 weight percent crosslinked gel content and has a gloss value of from about 5 to about 10 gloss units, and the second polyester resin is present in an amount of from about 80 to about 20 weight percent of the resin mixture and contains from 5 to about 15 weight percent crosslinked gel content and has a gloss value of from about 20 to about 30 gloss units, wherein the resulting melt blended toner mixture has an intermediate gloss value of about 10 to about 25 Gardner gloss units at 188° C. and 1.05 developed mass per area, and wherein the crosslinked gel content remains substantially constant throughout the process.

2. A process in accordance with claim 1, wherein the first polyester resin has a fusing range of about 160 to about 215° C., the second polyester resin has a fusing range of about 145° to about 215° C., and the toner mixture has a fusing latitude of about 20° C. to about 25° C.

3. A process in accordance with claim 1, wherein the melt blending is accomplished in a batch or a continuous melt mixing process.

4. A process in accordance with claim 1, wherein the melt blending is accomplished at a temperature of about 70° to about 160° C.

5. A process in accordance with claim 1, wherein the second polyester resin contains from about 85 to about 95 weight percent uncrosslinked or linear unsaturated polyester resin.

6. A process in accordance with claim 5, wherein the linear unsaturated polyester resin has a number average molecular weight (Mn) as measured by gel permeation chromatography (GPC) in the range from 1,000 to about 20,000, a weight average molecular weight (Mw) in the range from 2,000 to about 40,000, a molecular weight distribution (Mw/Mn) in the range from about 1.5 to about 6, an onset glass transition temperature ($T_g$) as measured by differential scanning calorimetry in the range from 50° C. to about 70° C., a degree of unsaturation from about 0.1 to about 30 mole percent, and a melt viscosity as measured with a mechanical viscometer at 10 radians per second from about 5,000 to about 200,000 poise at 100° C., said melt viscosity dropping with increasing temperature to about 100 to about 5,000 poise at 130° C.

7. A process in accordance with claim 5, wherein the linear unsaturated polyester resin is prepared from (a) diacids, diesters or anhydrides selected from the group consisting of succinic acid, glutaric acid, adipic acid, pimelic acid, suberic acid, azelaic acid, sebacic acid, isophthalic acid, terephthalic acid, hexachloroendomethylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, maleic acid, fumaric acid, chloromaleic acid, itaconic acid, citraconic acid, mesaconic acid, maleic anhydride, ester derivatives thereof, and mixtures thereof, and (b) diols selected from the group consisting of propylene glycol, ethylene glycol, diethylene glycol, neopentyl glycol, dipropylene glycol, dibromoneopentyl glycol, propoxylated bisphenol-A, 2,2,4-trimethylpentane-1,3-diol, tetrabromobisphenol dipropoxy ether, 1,4-butanediol, 1,3 butanediol, and mixtures thereof.

8. A process in accordance with claim 1, wherein the resulting melt blended mixture has a minimum fix temperature below about 170° C. and a fusing latitude of greater than about 30° C.

9. A process in accordance with claim 1, wherein the mixture has a minimum fix temperature below about 160° C.

10. A process in accordance with claim 1 wherein the weight ratio of the first polyester to the second polyester is from about 1:3 to about 3:1.

11. A process in accordance with claim 1, wherein said toner mixture provides a minimum fix temperature of a toner from about 155° C. to about 175° C., a hot offset temperature of from about 165° C. to about 220° C., and the mixture has substantially no vinyl offset.

12. A process in accordance with claim 1, further comprising adding to the melt blending resin mixture in an amount of about 0.1 to about 50 weight percent based on the weight of resins, at least one member selected from the group consisting of a charge control additive, a surfactant, an emulsifier, a wax, and a pigment dispersant, and thereafter mixing to form the toner mixture.

13. A process in accordance with claim 12, further comprising forming solid toner particles from the melt blended toner mixture.

14. A process in accordance with claim 12, wherein the colorant is selected from the group consisting of cyan, magenta, yellow, red, green, blue, carbon black, magnetite, and mixtures thereof.

15. A process in accordance with claim 12, wherein said charge control additive is selected from the group consisting of alkyl pyridinium halides, zinc stearate, distearyl dimethyl ammonium methyl sulfate, metallic alkyl salicylates, submicron sized fumed metal oxide particles with optional surface additives thereon, and mixtures thereof.

16. A process in accordance with claim 13, further comprising combining carrier particles with the toner particles to form a developer.

17. A process in accordance with claim 12 wherein from 1 to about 3 waxes are selected.

18. A process in accordance with claim 12 wherein the melt mixing is accomplished in an extruder and includes providing water injection into the extruder at a downstream location to achieve a lower temperature and a higher shear stress condition with respect to the melt mixture thereby providing enhanced mixing and enhanced pigment dispersion in the resulting toner mixture.

19. A process in accordance with claim 12 wherein an extruder is selected for melt blending and the extruder barrel temperature is from about 70° C. to about 160° C.; the temperature range for mixing the partially crosslinked thermoplastic resin mixture, pigment, and optional additives in the upstream barrel sections immediately following an extruder supply port is from about the melting temperature of the resin mixture to below a crosslinking temperature; and the rotational speed of the extruder screw ranges from about 50 to about 500 revolutions per minute.

20. A process in accordance with claim 12 wherein the pigmented toner has a fusing latitude from about 10° to about 100° C.

21. A process in accordance with claim 12 wherein the pigmented toner has a fusing latitude of from about 5° to about 20° C.

22. A process in accordance with claim 12 wherein the pigmented toner has an onset glass transition temperature of from about 50° C. to about 70° C. and a melt viscosity, at 10 radians per second, from about 5,000 to about 250,000 poise at about 100° C. and from about 10 to about 25,000 poise at about 160° C.

23. A process in accordance with claim 12 wherein the optional additives are selected from the group consisting of alkyl pyridinium halides, organic sulfates, organic bisulfates, organic sulfonates, distearyl dimethyl ammonium methyl sulfate, distearyl dimethyl ammonium bisulfate, cetyl pyridinium lakes, charge controlling pigments and dyes, polyvinyl pyridine, treated carbon blacks, tetraphenyl borate salts, phosphonium salts, nigrosine, metal-salicylate salts, polystyrene-polyethyleneoxide block copolymer salt complexes, poly(dimethyl amino methyl methacrylate), organo-aluminum salts, hydrophobically surface treated submicron silica particles, hydrophobically surface treated submicron titanium dioxide particles, fluorinated surfactants, zinc stearate, and mixtures thereof.

24. A process in accordance with claim 1 wherein uniform pigment dispersion is achieved.

25. A process in accordance with claim 1 wherein the pigmented toner comprises from about 4 to about 15 weight percent of colorant, and from about 75 to about 96 weight percent of a melt blended resin mixture comprising a mixture of from about 10 to about 20 weight percent crosslinked resin, and of from about 90 to about 80 weight percent uncrosslinked resin.

26. A process in accordance with claim 1, wherein the first polyester resin has a fusing range of about 170° to about 215° C., the second polyester resin has a fusing range of about 148° C. to at least about 215° C., and the toner mixture has a fusing latitude of greater than about 20° C.

* * * * *